United States Patent [19]

Zafiroglu

[11] Patent Number: 4,704,321

[45] Date of Patent: Nov. 3, 1987

[54] STITCHED POLYETHYLENE PLEXIFILAMENTARY SHEET

[75] Inventor: Dimitri P. Zafiroglu, Greenville, Del.

[73] Assignee: E. I. Du Pont de Nemours and Company, Wilmington, Del.

[21] Appl. No.: 927,594

[22] Filed: Nov. 5, 1986

[51] Int. Cl.[4] ..... D03D 3/00

[52] U.S. Cl. ..... 428/230; 28/107; 112/413; 112/438; 428/102

[58] Field of Search ..... 428/102, 230; 28/107; 112/413, 438

[56] References Cited

U.S. PATENT DOCUMENTS

| | | | |
|---|---|---|---|
| 3,081,519 | 3/1963 | Blades et al. | 28/21 |
| 3,169,899 | 2/1965 | Steuber | 161/72 |
| 3,532,589 | 10/1970 | David | 161/150 |
| 3,649,428 | 3/1972 | Hughes | 161/50 |
| 3,769,815 | 11/1973 | Ploch et al. | 66/85 A |

OTHER PUBLICATIONS

Product Licensing Index, Research Disclosure, "Stitch-bonded Products of Continuous Filament Nonwoven Webs", p. 30 (Jun. 1968).

F. W. Bahlo, "New Fabrics Without Weaving", Papers of the American Association for Textile Technology, Inc., pp. 51–54 (Nov. 1985).

*Primary Examiner*—Marion C. McCamish

[57] ABSTRACT

A nonwoven fabric is provided which comprises a layer of nonbonded, polyethylene, plexifilamentary film-fibril strands, which layer is multi-needle stitched with a stitching thread that forms spaced-apart, parallel rows of stitches in the fabric. Stitching thread of spandex yarn which causes the fabric to contract to 35 to 70% of its original area is preferred. The nonwoven fabric is particularly suited for use as a wipe-cloth.

10 Claims, No Drawings

STITCHED POLYETHYLENE PLEXIFILAMENTARY SHEET

BACKGROUND OF THE INVENTION

1. Field of the Invention

This invention concerns a multi-needle stitched layer of nonbonded, polyethylene, plexifilamentary film-fibril strands, which forms a nonwoven fabric that is particularly useful as a wipe-cloth. The invention also concerns a process for making the nonwoven fabric.

2. Description of the Prior Art

Many types of woven and nonwoven materials have been used and suggested for use as a wipe-cloth (also sometimes called a "dust-cloth"). Superior wipe-cloths should possess several important characteristics. Such wipe-cloths should absorb or lift dust and oily films from a surface without leaving lint or a residue on the wiped surface. The cloths should be soft to prevent scratching of the surface being cleaned. Further, the cloths should have sufficient stability to permit thorough rubbing of the surface without linting or destruction of the cloth. Removed dust should be retained by the wipe-cloth and not drop off the cloth until the cloth is vigorously shaken. Some known dust-cloths are impregnated with an oily substance to assist in dust particle pickup and retention, but these often leave a residual film on the wiped surface.

Nonwoven sheets made from plexifilamentary strands of polyethylene film fibrils are known. Blades et al, U.S. Pat. No. 3,081,519, discloses, flash spinning of plexifilamentary strands of polyethylene film fibrils. Steuber, U.S. Pat. No. 3,169,899, discloses depositing such strands onto a moving receiver to form a nonwoven sheet. Methods of assembling strands deposited from a plurality of positions are disclosed by Knee, U.S. Pat. No. 3,402,227. Improved methods for depositing flash-spun plexifilamentary strands and forming them into sheets are disclosed by Pollock et al, U.S. Pat. No. 3,497,918. Bonded sheets are disclosed by David, U.S. Pat. No. 3,532,589.

The aforementioned methods have been used commercially in the manufacture of nonwoven sheet of polyethylene plexifilamentary strands. Sheet product, sold under the trademark "Tyvek" spunbonded polyolefin by E. I. du Pont de Nemours & Co., has been found useful in many applications. However, Applicant has found that when these sheets were tried for use as wipe cloths, the sheets were unsatisfactory. Such sheets in bonded form did not pick up or retain dust adequately. Nonbonded sheets did not have sufficient surface stability to permit any significant scrubbing or rubbing without destruction of the sheet surface.

Multi-needle stitching machines, generally known as "Arachne" or "Mali" machines (including Malimo, Malipol and Maliwatt machines) are known and have been used to insert stitches into a wide variety of fibrous substrates. Such machines and some of the fabrics produced therewith are disclosed by K. W. Bahlo, "New Fabrics Without Weaving", Papers of the American Association for Textile Technology, Inc., pp. 51–54 (November, 1965). Other disclosures of the use of such machines appear for example, in Ploch et al, U.S. Pat. No. 3,769,815, Hughes, U.S. Pat. No. 3,649,428 and Product Licensing Index, Research Disclosure, "Stitch-bonded products of continuous filament nonwoven webs", p. 30 (June 1968). However, none of these disclosures concern stitching of sheets of polyethylene plexifilamentary film-fibril strands.

An object of the present invention is to provide a nonwoven fabric which overcomes the shortcomings associated with sheets of polyethylene plexifilamentary film-fibril strands and indeed provides a superior material for use as a wipe-cloth.

SUMMARY OF THE INVENTION

The present invention provides a nonwoven fabric which comprises a layer of nonbonded, polyethylene plexifilamentary film-fibril strands, the layer being stitched through with thread that forms spaced apart rows of stitches extending along the length of the fabric, the row spacing being in the range of 2 to 10 rows per centimeter, preferably 3 to 6 per cm, and the stitch spacing being in the range of 2 to 15 stitches per centimeter, preferably 4 to 12 per cm. Usually, the nonbonded layer of polyethylene strands has a unit weight in the range of 30 to 200 grams per square meter, preferably 50 to 150 g/m$^2$. The stitching thread usually amounts to 2 to 40%, preferably 5 to 10%, of the total weight of the nonwoven fabric. A preferred stitching thread is a spandex elastomeric yarn.

The present invention also provides a process for making the above-described nonwoven fabric, wherein a lightly consolidated nonwoven sheet of flash-spun, polyethylene plexifilamentary film-fibril strands is multi-needle stitched with stitching thread that forms spaced-apart, parallel rows of stitches in the sheet, the needle spacing being in the range of 2 to 5 needles per cm, and the stitches within each row being inserted at a spacing in the range the range of 1 to 7 stitches per centimeter, preferably 2 to 5 stitches per cm. Preferably the stitches are formed with a stitching thread that is under sufficient tension to elongate the thread in the range of 100 to 250%. Then, release of the tension permits the thread to retract and cause the fabric to contract. In a preferred process, the fabric area after release of the tension is in the range of 35 to 70% of the original area of the consolidated sheet.

DETAILED DESCRIPTION OF PREFERRED EMBODIENTS

The invention will now be illustrated in detail with regard to a preferred nonwoven fabric made from a layer of nonbonded polyethylene plexifilamentary film-fibril strands which is multi-needle stitched.

As used herein, the term "polyethylene" is intended to embrace not only homopolymers of ethylene but also copolymers wherein at least 85% of the recurring units are ethylene units. The preferred polyethylene polymer is a homopolymeric linear polyethylene which has an upper limit of melting range of about 134°–135° C. (as measured with a differential thermal analyzer operated at a heating rate of 10° C. per minute), a density in the range of 0.94 to 0.96 g/cm$^3$ and a melt index (as defined by ASTM D-1238-57T, Condition E) of 0.1 to 6.0.

The term "nonbonded", as used herein, with regard to the sheet of polyethylene plexifilamentary film-fibril strands, means that the strands are not bonded to each other by chemical or thermal action.

The plexifilamentary film-fibril strands of which the sheet of the invention is composed are of the type disclosed in Blades et al, U.S. Pat. No. 3,081,519. The film fibrils are very thin ribbon-like fibrous element, which usually are less than 4-microns thick, as measured by interference microscopy. The film fibrils are interconnected and form an integral network within the plexifilamentary strand.

The preferred starting nonwoven layer of polyethylene plexifilamentary film-fibril strands used for preparing the nonwoven fabric of the invention is prepared by the general methods disclosed by Steuber, U.S. Pat. No. 3,081,519. The preferred layer is a nonbonded sheet. The sheet is only lightly consolidated. To prepare the preferred starting sheet, linear polyethylene having a density of 0.95 g/cm$^3$, a melt index of 0.9 and an upper limit of the melting range of about 135° C., is flash-spun from a 12.5% solution of the polymer in trichlorofluoromethane. The solution is continuously pumped to spinneret assemblies at a temperature of 179° C. and a pressure above about 8610 kPa. In each spinneret assembly, the solution is passed through a first orifice to a pressure let-down zone and then through a second orifice into the surrounding atmosphere. The resulting film-fibril strand is spread and oscillated by means of a shaped rotating baffle, is electrostatically charged and then is deposited on a moving belt. The spinneret assemblies are spaced to provide overlapping intersecting deposits on the belt to form a batt. The batt is lightly compressed by passage through a nip that applies a load of 17.6 N/cm of batt width to form a lightly consolidated sheet, which serves as starting material for the stitching step of the present invention. Further details concerning the fabrication of the lightly consolidated, nonbonded sheet of polyethylene film-fibril strands are disclosed in Lee, U.S. Pat. No. 4,554,207, column 4, line 63, through column 5, line 60, which disclosure is hereby incorporated by reference. Generally, for use in the present invention, such lightly consolidated sheet has a unit weight in the range of 20 to 150 g/m$^2$ and a density in the range of 0.15 to 0.3 g/cm$^3$. The thusly prepared sheet is usually wound up as a roll. When heavier final products of the invention are desired, layers of such sheet can be positioned upon each other in preparation for the subsequent stitching step. Two or more layers can be used to make up the required sheet of polyethylene plexifilamentary film-fibril strands that subsequently will be stitched to form the fabric of the invention. However, one layer of lightly consolidated sheet is preferred for processing ease and economy.

In accordance with the process of the present invention, the stitching operation can be carried out with conventional muti-needle stitching equipment, for example of the Mali type mentioned hereinbefore. Malimo multi-needle stitching machines are particularly useful for making the nonwoven fabrics of the present invention. In the stitching step, spaced apart rows of stitches, generally extending along the length of the fabric, penetrate the nonbonded sheet of polyethylene plexifilamentary film-fibril strands. This type of multi-needle stitching is sometimes referred to in the art as "stitch bonding".

Substantially any thread is suitable as the stitching thread for use in the present invention. However, preferred threads are those that can provide a force that will cause to polyethylene plexifilamentary strand layer to contract or pucker. For example, conventional stretch yarns that can elongate and retract (e.g., spandex yarns) or yarns that can be made to shrink after stitching (e.g., heat or steam shrinkable yarns) can be used satisfactorily to form the required stitching pattern. Also, the retractive force of the stitching can sometimes provided by a mechanical pre-treatment of the yarn (e.g., stuffer-box crimped or other textured yarns) to form retractive forces that can be activated by a thermal or chemical treatment that does not adversely affect the polyethylene substrate, but causes the yarns to shrink and apply the desired retractive force.

A particularly preferred stitching thread is formed from spandex yarn which has high elongation and high retractive power. Such preferred yarns are available commercially (e.g., "Lycra" spandex yarn manufactured by E. I. du Pont de Nemours and Company). The spandex yarn can be inserted into the sheet under tension in stretched condition, so that when the tension is released, the retractive forces of the yarns cause the sheet to contract and pucker. Preferred yarns can elongate and retract in the range of 100 to 250%. Stretch yarns, for example of nylon or polyester, can function in a somewhat similar manner to spandex yarns, but usually with considerably less elongation and retraction.

In a preferred stitching step of the process, the multi-needle stitching machine forms parallel chains of interlocked loops on one surface of the nonwoven polyethylene plexifilamentary sheet and a parallel series of zig-zag tricot stitches on the other surface. Such rows of stitches are typical of those made by a "Mali" or an "Arachne" multi-needle stitching machine. Alternatively, the stitching can form substantially parallel rows of chain stitches along the length of the fabric. In embodiments of the invention in which fabric area contraction is caused by shrinkage or retraction of the stitching, chain stitches cause almost all the contraction to take place in the direction of the stitching (i.e., along the length of the fabric) whereas tricot stitches cause contraction across the width as well as the length of the fabric. The rows of stitches are inserted by needles having a spacing in the range of 2 to 5 needles per cm and the stitches in each row are inserted at a spacing in the range of 1 to 7 stitches per cm, preferably 2 to 5 stitches per cm.

The nonwoven fabric of the invention, as shown in Examples 1–3 below, is particularly especially suited for use as a wipe-cloth. When the nonwoven fabric is fashioned into a simple mitten, an especially useful form of dust-cloth results. The fabric also has utility in other applications. For example, because of its structure, the nonwoven fabric has a high insulating value and therefore is suitable for use in thin insulative gloves, in thermal underwear, and the like.

EXAMPLES 1–3

These examples illustrate the fabrication of three fabrics of the invention. The advantages of these fabrics as wipe-cloths are demonstrated by comparing their wiping performance with some commercial and other known wipe-cloths.

The starting material for each of the three fabrics of the invention was a layer of nonbonded, lightly consolidated, flash-spun strands of polyethylene film fibrils. The layer weighed 40.7 grams/m$^2$ and was prepared by the method described in detail hereinbefore with regard to the process for preparing a preferred starting nonwoven layer of polyethylene plexifilamentary film-fibril strands in accordance with U.S. Pat. No. 3,081,519.

A roll of the polyethylene plexifilamentary starting sheet, measuring 50.8-cm wide, was mounted for feeding in the machine direction of a Malimo multi-needle stitching machine. A spandex yarn ("LYCRA" type-126, available commercially fron E. I. du Pont de Nemours and Company) was used as the stitching yarn for each fabric. A stitch length of 2 mm (i.e., 5 per cm) and a 12 gauge needle bar (i.e., 12 needles per 25 mm) were employed. Sufficient tension was placed on the yarn to provide a thread elongation of about 200% or more. The machine was operated to form 750 courses per minute which corresponded to stitching a length about 1.5 meters of polyethylene sheet layer per minute.

Table I summarizes the manufacture of the nonwoven fabrics. In particular, the Table lists the type of stitch inserted (i.e., chain stitch or tricot stitch), the number of stitches per cm in each row, the row spacing, the amount of stretch imparted to the stitching yarn as it was stitched through the consolidated layer, and the amount of area contraction experienced by the polyethylene film-fibril layer, etc.

TABLE I

| Fabrication of Nowoven Fabrics of the Invention | | | |
|---|---|---|---|
| Example number | 1 | 2 | 3 |
| Polyethylene layer Weight, g/m$^2$ | 40.7 | 40.7 | 40.7 |
| Spandex stitching yarn | | | |
| Stitch type | chain | chain | tricot |
| dtex | 156 | 44 | 156 |
| % stretch(1) | 250 | 200 | 190 |
| Finished fabric | | | |
| Stitches per cm | | | |
| along length | 12.2 | 10.2 | 9.5 |
| along width | 4.9 | 4.9 | 6.9 |
| Weights, g/m$^2$ | | | |
| Polyethylene | 119 | 115 | 139 |
| Stitching | 21 | 5.8 | 31 |
| % stitching | 17 | 5 | 22 |
| Contracted dimensions(2) | | | |
| Length, % | 49 | 51 | 53 |
| Width, % | 97.5 | 97.5 | 70 |
| Area, % | 40 | 48 | 37 |

Notes:
(1)% elongation imposed on stitching thread by tension during stitch formation
(2)all contracted dimensions are expressed as a percentage of the original dimension, e.g., contracted area, % = (finished sheet area/original area) (100)

The performance each of the three fabrics of the invention as a wipe-cloth was compared to that of several commercial dust-cloths by a dust-pickup test. In this test, a synthetic dust was spread on a smooth, polished surface of dark, smoky, scratch-resistant "Lucite" SAR and then wiped by hand with the test cloth. The synthetic dust consisted of about 75 parts by volume home-laundry-drier lint and 25 parts of automotive air-cleaner test dust (the latter, a product of AC Delco Division of General Motors Corporation). The synthetic dust was placed in a large "salt shaker" and sprinkled therefrom onto the surface in a thin layer. Performance of the test cloth in picking up dust, in retaining the dust on the cloth, and in not leaving any film on the surface was subjectively rated: 1 for excellent; 2 for fair; and 3 for poor. The test samples of invention were rated against the following control materials:

A. "Sontara" style 8803, 80/20 woodpulp/polyester nonwoven industrial wipe made by E. I. du Pont de Nemours & Co., Wilmington, Del.

B. "Economizers" Brand No. 05800, disposable wipe made by Scott Paper Company, Philadelphia, Pa.

C. Yellow nonwoven cloth with lemon oil on it made by Scott Paper Company.

D. "Guardian One-Wipe" dust cloth with some oil in it made by Guardian Chemicals Inc., Consumer Products Div., Grand Rapids, Mich.

E. "Masslinn" sports towel made by Chicopee, Milltown, N.J.

F. Chamois cloth made by Drutan Products, Bradford, Me.

The results of the tests are given in Table II.

TABLE II

| Test Sample | Dust Pickup | Dust Retain | Film Residue |
|---|---|---|---|
| 1 | 1 | 1 | 1 |
| 2 | 1 | 1 | 1 |
| 3 | 1 | 1 | 1 |
| A | 2 | 2 | 1 |
| B | 3 | 3 | 1 |
| C | 2 | 1 | 3 |
| D | 2 | 1 | 3 |
| E | 3 | 3 | 1 |
| F | 1 | 1 | 1 |

As shown by Table II, the fabrics of the invention were rated "excellent" in picking up and retaining picked-up dust, as well as in leaving no oily film on the surface. In contrast, comparison samples C and D left an oily film on the surface. Only the test samples of the invention were able to easily remove the oily film left by such comparison samples. The only other material that rated "excellent" in the three rated categories was chamois cloth (sample F), a much more expensive natural product that still could not remove oily films from the surface as readily as could the nonwoven fabrics of the invention.

When samples of the invention, which were made without significant area contraction, were subjected to the above-described tests, they also were rated "excellent", but required somewhat more rubbing to remove residual films left by wipes, such as C and D.

All the fabrics of the invention were excellent in being able to wipe oily films from the polished surface, such as those caused by fingermarks or thin layers of fine lubricating oils.

What is claimed is:

1. A nonwoven fabric which comprises a layer of nonbonded, polyethylene plexifilamentary film-fibril strands, the layer being stitched through with thread that forms spaced-apart, parallel rows of stitches in the layer, the row spacing being in the range of 2 to 10 rows per centimeter and the stitch spacing being in the range of 2 to 15 stitches per centimeter.

2. A nonwoven fabric of claim 1 wherein the nonbonded layer of polyethylene strands has a unit weight in the range of 20 to 200 grams per square meter.

3. A nonwoven fabric of claim 1 wherein the row spacing is in the range of 3 to 6 rows per cm, the stitch spacing is in the range of 4 to 12 stitches per cm and the unit weight of the nonbonded layer is in the range of 50 to 150 grams per square meter.

4. A nonwoven fabric of claim 1, 2 or 3 wherein the stitching thread is an elastomeric yarn and amounts to 5 to 10% of the total weight of the fabric.

5. A process for making a nonwoven fabric of claim 1 wherein lightly consolidated, nonwoven sheet of flash-spun, polyethylene plexifilamentary film-fibril strands, is multi-needle stitched through with stitching thread that forms spaced-apart, parallel rows of stitches in the sheet, the needle spacing being in the range of 2 to 5 needles per centimeter and the stitches within each row being inserted at a spacing in the range of 1 to 7 stitches per centimeter.

6. A process of claim 5 wherein the stitch spacing is in the range of 2 to 5 stitches per centimeter.

7. A process of claim 5 wherein the stitching is formed with stitching thread which, when activated, exerts sufficient retractive force to cause the nonwoven sheet to contract to a finished area that is in the range of 35 to 70% of the original fabric area.

8. A process of claim 7 wherein the retractive force on the stitching thread in the thusly formed multi-needle stitched sheet is activated.

9. A process of claim 8 wherein the stitches are inserted with the stitching thread under a tension that elongates the stitching thread in the range of 100 to 250% and then the tension is released to permit the fabric to contract.

10. A process of claim 7, 8 or 9 wherein the stitching thread is a spandex yarn.

* * * * *